US010758443B1

(12) United States Patent
Nau

(10) Patent No.: US 10,758,443 B1
(45) Date of Patent: Sep. 1, 2020

(54) PATIENT LIFTING APPARATUS

(71) Applicant: Kevin Nau, Stover, MO (US)

(72) Inventor: Kevin Nau, Stover, MO (US)

( * ) Notice: Subject to any disclaimer, the term of this patent is extended or adjusted under 35 U.S.C. 154(b) by 0 days.

(21) Appl. No.: 16/454,422

(22) Filed: Jun. 27, 2019

(51) Int. Cl.
*A61G 7/10* (2006.01)

(52) U.S. Cl.
CPC ..... *A61G 7/1015* (2013.01); *A61G 7/1011* (2013.01); *A61G 7/1046* (2013.01); *A61G 7/1074* (2013.01)

(58) Field of Classification Search
CPC .. A61G 5/0833; A61G 7/1003; A61G 7/1005; A61G 7/1011; A61G 7/1015; A61G 7/1046; A61G 7/1057; A61G 7/1074; A61G 15/002; B66C 23/485
See application file for complete search history.

(56) References Cited

U.S. PATENT DOCUMENTS

| | | | | |
|---|---|---|---|---|
| 2,585,982 | A * | 2/1952 | Wood | A61G 7/1074 254/99 |
| 4,944,057 | A | 7/1990 | Shaw | |
| 4,985,947 | A | 1/1991 | Ethridge | |
| 5,090,072 | A * | 2/1992 | Gray | A61G 7/1019 5/86.1 |
| 5,692,254 | A * | 12/1997 | Boettcher | A61G 7/1017 5/611 |
| 5,934,490 | A * | 8/1999 | Mora | B25H 1/0007 212/176 |
| 6,260,218 | B1 * | 7/2001 | Tsuga | A61G 7/1019 5/86.1 |
| 6,321,398 | B1 * | 11/2001 | Wang | A61G 7/001 212/901 |
| 6,430,761 | B1 | 8/2002 | Brandorff | |
| 6,976,698 | B2 | 12/2005 | Kulken | |
| 7,328,467 | B2 | 2/2008 | Aarestad | |
| 9,925,105 | B1 * | 3/2018 | Hines | A61G 7/1011 |
| 2011/0016628 | A1 * | 1/2011 | Masterson, Jr. | A61G 7/1015 5/87.1 |
| 2011/0138532 | A1 * | 6/2011 | Lin | A61G 7/1046 5/86.1 |
| 2011/0296608 | A1 * | 12/2011 | Victor | A61G 7/1059 5/83.1 |
| 2016/0143795 | A1 | 5/2016 | Schwartz | |
| 2016/0262967 | A1 * | 9/2016 | Mitchell | A61G 7/1051 |
| 2020/0030169 | A1 * | 1/2020 | Krinjak | A61G 7/1015 |

FOREIGN PATENT DOCUMENTS

| | | | | |
|---|---|---|---|---|
| EP | 1036552 | A1 * | 9/2000 | A61G 7/1094 |
| EP | 1036552 | A1 | 9/2000 | |
| GB | 2463960 | A * | 4/2010 | A61G 7/1011 |

* cited by examiner

*Primary Examiner* — Nicholas F Polito
(74) *Attorney, Agent, or Firm* — IPS Legal Group, P.A.; Jocelyn S. Brown

(57) ABSTRACT

An improved patient lifting apparatus comprising a base frame and a vertically disposed pulley system extending upwardly from the base frame. A patient support platform extends from the primary spine column to support the patient and is raised or lowered to different levels by engaging the crank to operate the pulley system.

11 Claims, 6 Drawing Sheets

PATIENT LIFTING APPARATUS

CROSS-REFERENCE TO RELATED APPLICATION

Not applicable.

TECHNICAL FIELD

The present invention relates generally to devices for assisting elderly, injured, or physically disabled individuals move from a floor position to a seated or standing position. More specifically, the present invention relates to a manually operated lifting device for assisting an individual rise from the floor to a chair, bed, or standing position.

BACKGROUND

The most common types of injuries suffered by healthcare workers and care givers are back strains and sprains due to lifting patients improperly. Lifting and transferring disabled and elderly patients is a leading cause of industry in the healthcare industry where nurses have the highest risk and incident of injury. This may be due to the weight of the individual, the position of the individual, or the strength of the healthcare worker or caregiver. Despite the cause of the injury, several methods, devices, and apparatuses have been promoted to reduce the risk of injury when lifting or moving a disabled, injured, or elderly patient, the risk of injury and incident of injury continues to increase.

Various attempts have been made, although unsuccessfully, to solve this problem. One illustrative attempt can be seen with respect to U.S. Pat. No. 4,944,057, which generally discloses a patient support and lifting device. While this disclosure does involve a device that aids in lifting and moving an individual from one location to another, it fails to provide for a means to lift and move an individual with out added strain or stress to the user's back.

Another example can be seen with respect to U.S. Pat. No. 4,985,947, which generally discloses a machine for assisting a partially ambulatory user to rise and move about. While this disclosure does involve a device that aids in the movement of an individual, the device is self-operated and does not provide for a means for a second party to lift and move an immobile or partially ambulatory individual.

As can be seen, various attempts have been made to solve the problems which may be found in the related art but have been unsuccessful. A need exists for a new patient lifting device to avoid the challenges and problems with the prior art.

SUMMARY OF THE INVENTION

It is to be understood that in the present disclosure, all embodiments are provided as illustrative and non-limiting representatives of many possible embodiments. In addition, the terms "is," "can," "will," and the like are herein used as synonyms for and interchangeable with terms such as "may," "may provide for," and "it is contemplated that the present invention may" and so forth.

Furthermore, all elements listed by name, such as a platform, crank, and so forth are herein meant to include or encompass all equivalents for such elements. For example, in addition to a "platform," any item sufficiently equipped to raise of lift a human being is also contemplated by the present invention. Such equivalents are contemplated for each element named in its particular herein.

For purposes of summarizing, certain aspects, advantages, and novel features of the present invention are provided herein. It is to be understood that not all such aspects, advantages, or novel features may be provided in any one particular embodiment. Thus, the disclosed subject matter may be embodied or carried out in a manner that achieves or optimizes one aspect, advantage, or novel feature or group of features without achieving all aspects, advantages, or novel features as may be taught or suggested.

In view of the foregoing disadvantages inherent in the known art, the present invention relates to patient lifting apparatus that overcomes the deficiencies of the prior art. The general purpose of the present invention, which shall be described subsequently in greater detail, is to reduce the risk of injury when lifting or moving a disabled, injured, or elderly patient.

The features of the invention which are believed to be novel are particularly pointed out and distinctly claimed in the concluding portion of the specification. By way of non-limiting example, the present invention provides a novel solution for reducing the risk of injury when lifting or moving a disabled, injured, or elderly patient. These and other features, aspects, and advantages of the present invention will become better understood with reference to the following drawings and detailed description.

The present invention comprises an apparatus for moving and lifting individuals, particularly disabled and/or disabled persons. The apparatus of the present invention provides a system for conveniently moving or lifting an individual from a floor position to a seated or elevated position with minimal strain or stress to the user's back or body. The present invention provides for a patient lifting apparatus comprising a base frame with a front end and a rear end. The rear base frame has a T-shape, with the top of the T-shaped rear frame faces the user. In some embodiments, the T-shaped rear frame has an off-step to assist with stabilizing the apparatus when it is in use. In some embodiments, the T-shaped rear base frame can be detached from the front end of the base frame. The front end of the base frame is Y-shaped with at least a 165-degree angle opening.

In other embodiments, the spine of the invention extends vertically from where the T-shaped rear frame and Y-shaped front frame intersect. The spine also extends back towards the T-shaped rear frame at an angle that is at least 22 degrees. A detachable platform seat is detachably secured to the front of the frontward facing edge of the spine and can move up and down along the axis of the spine by means of a cable pulley system that runs the length of the spine. In some embodiments, the cable pulley system is controlled by a winch which is located on the upper back portion of the spine. Above the winch, and on the top rear of the spine, a handle extends towards the user to assist with stabilizing the movement of the invention. The cable pulley system effectively reduces the amount of force required operate the present invention.

To operate the present invention, a user must place the platform seat in the lowest position required to move or lift a person. If the individual who is in need of assistance is on the floor, then the user must position the platform seat flush with the surface floor. Next, the platform seat must be moved into position under the hips or buttocks of the person in need of assistance. Once positioned under the person in need of assistance, the winch must be cranked to activate the cable pulley, thereby raising the platform seat to the desired level.

The present invention may be portable and may provide for one or more ways to fold the patient lifting apparatus in a nearly flat and vertical or horizontal position for easy storage.

The embodiments of the invention described herein are exemplary and numerous modifications, variations and rearrangements can be readily envisioned to achieve substantially equivalent results, all of which are intended to be embraced within the spirit and scope of the invention. Furthermore, while the preferred embodiment of the invention has been described in terms of the components and configurations, it is understood to that the invention is not intended to be limited to those specific dimensions or configurations but is to be accorded the full breadth and scope of the spirit of the invention.

BRIEF DESCRIPTION OF THE DRAWINGS

These and other features, aspects and advantages of the present invention will become better understood with regard to the following description, appended claims, and accompanying figures where:

DETAILED DESCRIPTION

The present invention overcomes the limitations of the prior art by providing a new and more effective patient lifting device.

All dimensions specified in this disclosure are by way of example only and are not intended to be limiting. Further, the proportions shown in these Figures are not necessarily to scale. As will be understood by those with skill in the art with reference to this disclosure, the actual dimensions and proportions of any embodiment or element of an embodiment disclosed in this disclosure will be determined by its intended use.

It is to be understood that the drawings and the associated descriptions are provided to illustrate potential embodiments of the invention and not to limit the scope of the invention. Reference in the specification to "one embodiment" or "an embodiment" is intended to indicate that a particular feature, structure, or characteristic described in connection with the embodiment is included in at least an embodiment of the invention. The appearances of the phrase "in one embodiment" or "an embodiment" in various places in the specification are not necessarily all referring to the same embodiment.

Throughout the drawings, reference numbers are re-used to indicate correspondence between referenced elements. In addition, the first digit of each reference number indicates the figure where the element first appears.

As used in this disclosure, except where the context requires otherwise, the term "comprise" and variations of the term, such as "comprising", "comprises" and "comprised" are not intended to exclude other additives, components, integers or steps.

In the following description, specific details are given to provide a thorough understanding of the embodiments. However, it will be understood by one of ordinary skill in the art that the embodiments may be practiced without these specific details. Well-known features, elements or techniques may not be shown in detail in order not to obscure the embodiments.

Figure 1:
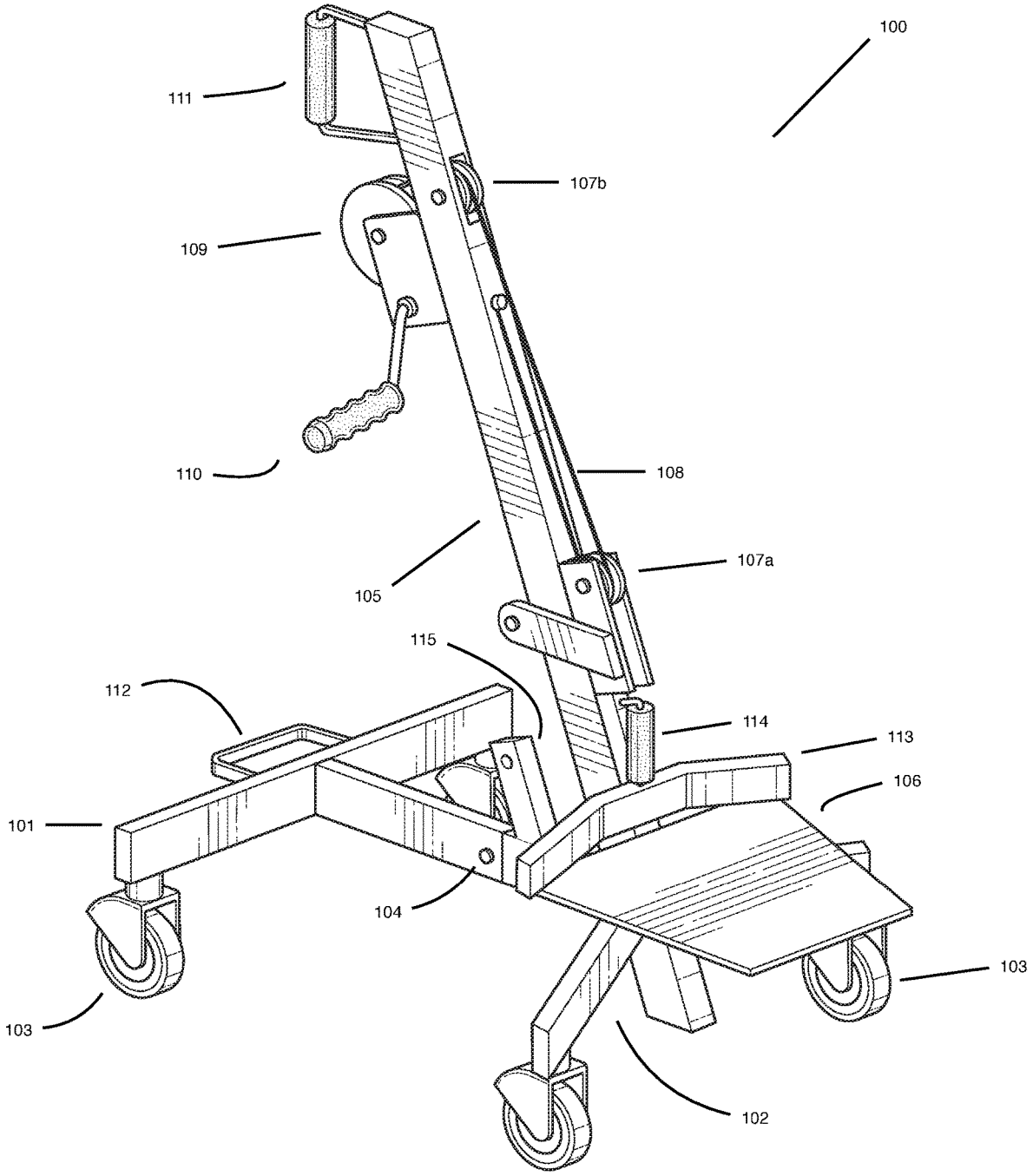
FIG. 1 shows a front perspective view of a patient lifting device in accordance with an embodiment of the invention.

Turning attention to FIG. 1, a front perspective view of a patient lifting apparatus 100 in accordance with an embodiment of the invention is shown. In the embodiment depicted, a viewer may perceive a rear frame member 101, a front frame member 102, resting on four wheels 103. A viewer may also perceive that the rear frame member 101 is T-shaped and the front frame member 102 is Y-shaped. The rear frame member 101 and the front frame member 102 are detachably connected with a pin 104 or other securing mechanism.

The patient lifting apparatus 100 also comprises a spine member 105 extending vertically from the front frame member 102. A platform seat 106 is detachably affixed to the spine member 105 and can be raised and lowered vertically along the spine by means of a two-wheel cable pulley system having a first wheel 107*a* and a second wheel 107*b* with circumferential groves (not shown) in which the rope 108 engages. The cable pulley system is operated by engaging the winch 109 which is controlled by a manual crank 110. As may be appreciated by those of skill in the art, while a two-wheel cable pulley system is shown in FIG. 1, embodiments with a one-wheel 107, three or more wheels 107, or no wheel 107 are also contemplated. The rope 108 or line may be comprised of any material known in the art such as, but not limited to, nylon, polypropylene, manila, Kevlar®, or polyester.

The present invention may also provide means for user stabilization while it is in use by means of a gripping handle 111 at the top of the spine member 105 and a foot stabilizer 112 at the back end of the rear frame member 101. Although the foot stabilizer 112 shown in FIG. 1 is rectangular shaped, other shape configurations are also contemplated such as a square, triangle, or circular shaped configurations.

In a preferred embodiment of the present invention, the platform seat 106 has a support frame 113 and a gate belt 114. The platform seat 106 may be of any material with sufficient strength to withstand the weight of a heavy object, such as but not limited to metal, wood, or plastic. Moreover, in some embodiments, the platform seat 106 may provide for one or more raised traction elements, or surface ornamentation such as elastomer portions that enable an individual to stay put on top of the platform seat 106. In some embodiments, the present invention may provide for two or more platforms 102, which may be connected or operating independently. In other embodiments, the gate belt 114 may be used to secure an individual to the platform seat 106 by looping a belt (not shown) through the gate belt 114 and around the individual's waist.

Figure 2:
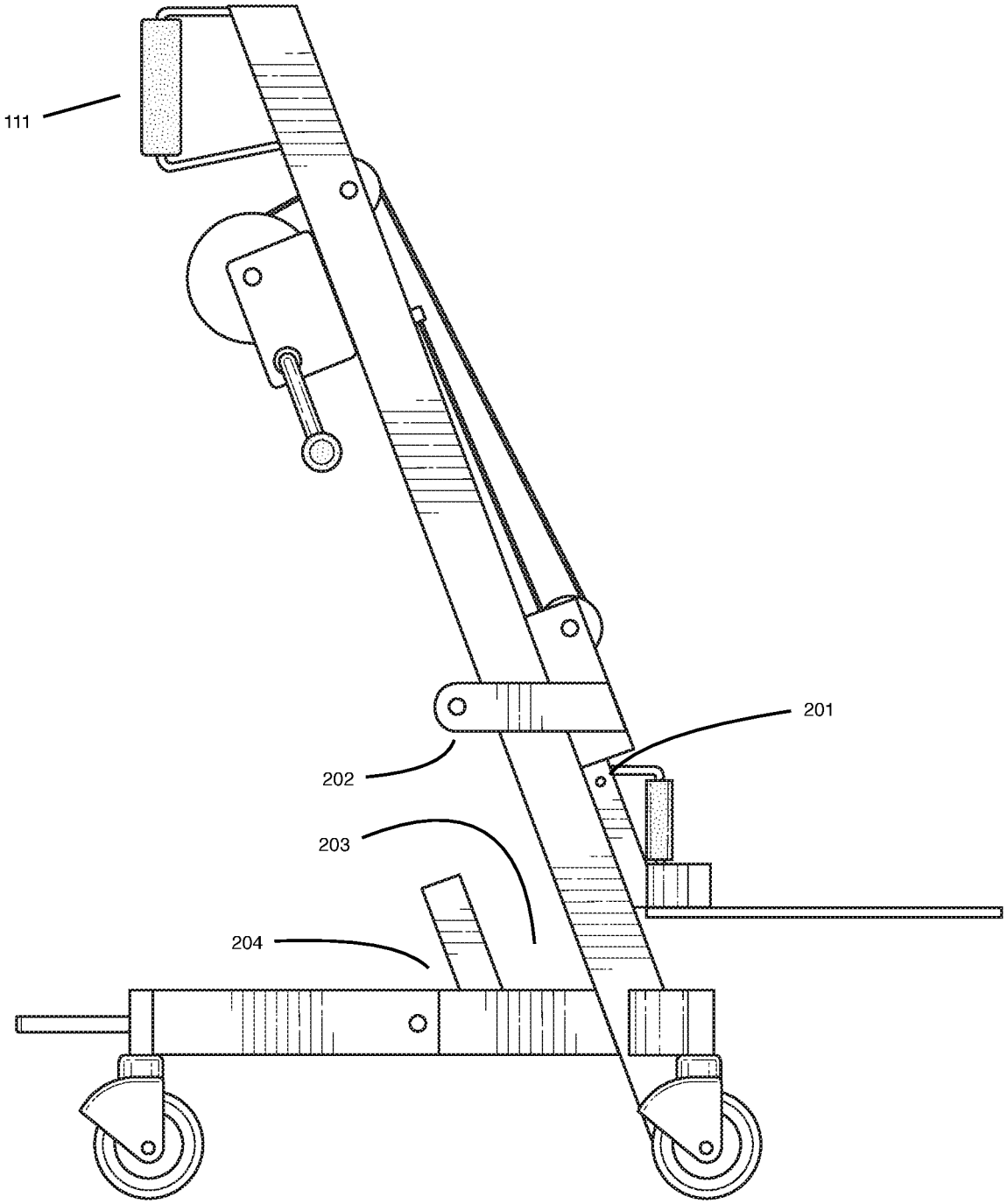
FIG. 2 shows a side view of a patient lifting device in accordance with an embodiment of the invention.

With respect to FIG. 2, a side view of a patient lifting apparatus 100 in accordance with an embodiment of the invention is shown. In the embodiment depicted, a viewer may perceive the platform seat 106, the winch 109 and crank 110, and the stabilizing handle 111.

FIG. 2 serves to show generally the relationship between the base frame 101 and 102, the spine 105, and the platform seat 106. The spine 105 extends upward from the front frame member 102 at an angle that is at least 22 degrees 203. The first wheel 107*a* is encased in a supporting frame 202 with arms that extend around the spine member 105 and are suitably spaced to allow for the first wheel 107*a* and frame 201 to move freely along the spine member 105. The platform seat 106 is detachably secured to the spine 105 with a securing pin 201 having at least ½ inches in diameter and length (not shown).

FIG. 2 also serves to illustrate the relationship between the cable pulley system wheels 107 and the spine 105. The first wheel 107*a* is encased in a supporting frame 202 with arms that extend around the spine member 105 and are suitably spaced to allow for the first wheel 107*a* and frame 201 to move freely along the spine member 105. In the embodiment depicted, a viewer may perceive a storage post 204 extending from the front frame member 102 at an angle of at least 22 degrees.

Figure 3:
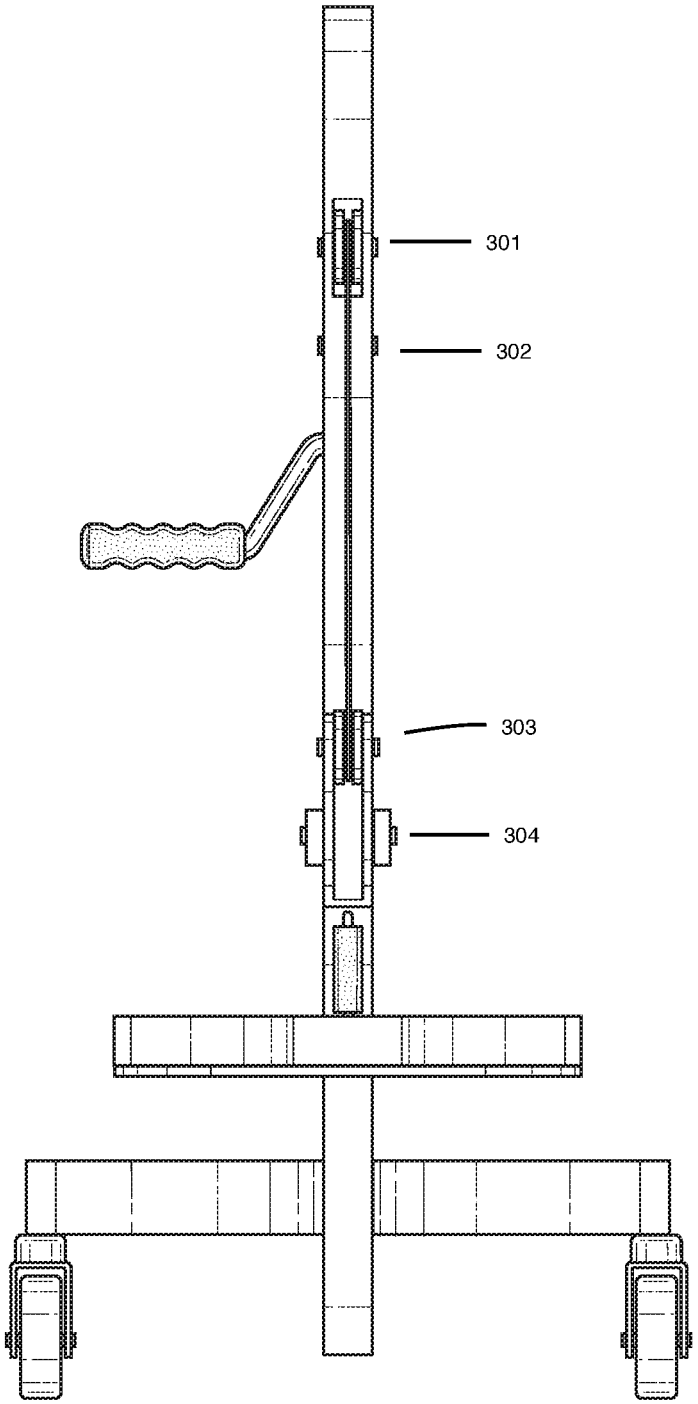
FIG. 3 shows a front view of a patient lifting device in accordance with an embodiment of the invention.

With regards to FIG. 3, a front view of a patient lifting apparatus in accordance with an embodiment of the invention is shown. FIG. 3 serves to show generally the relationship between the spine 105 and the securing pins of the cable pulley system. A viewer may perceive a plurality of engaging fasteners to secure the second wheel of the pulley system 301, the crank 302, the first wheel of the pulley system 303, and the supporting frame 304.

Figure 4:
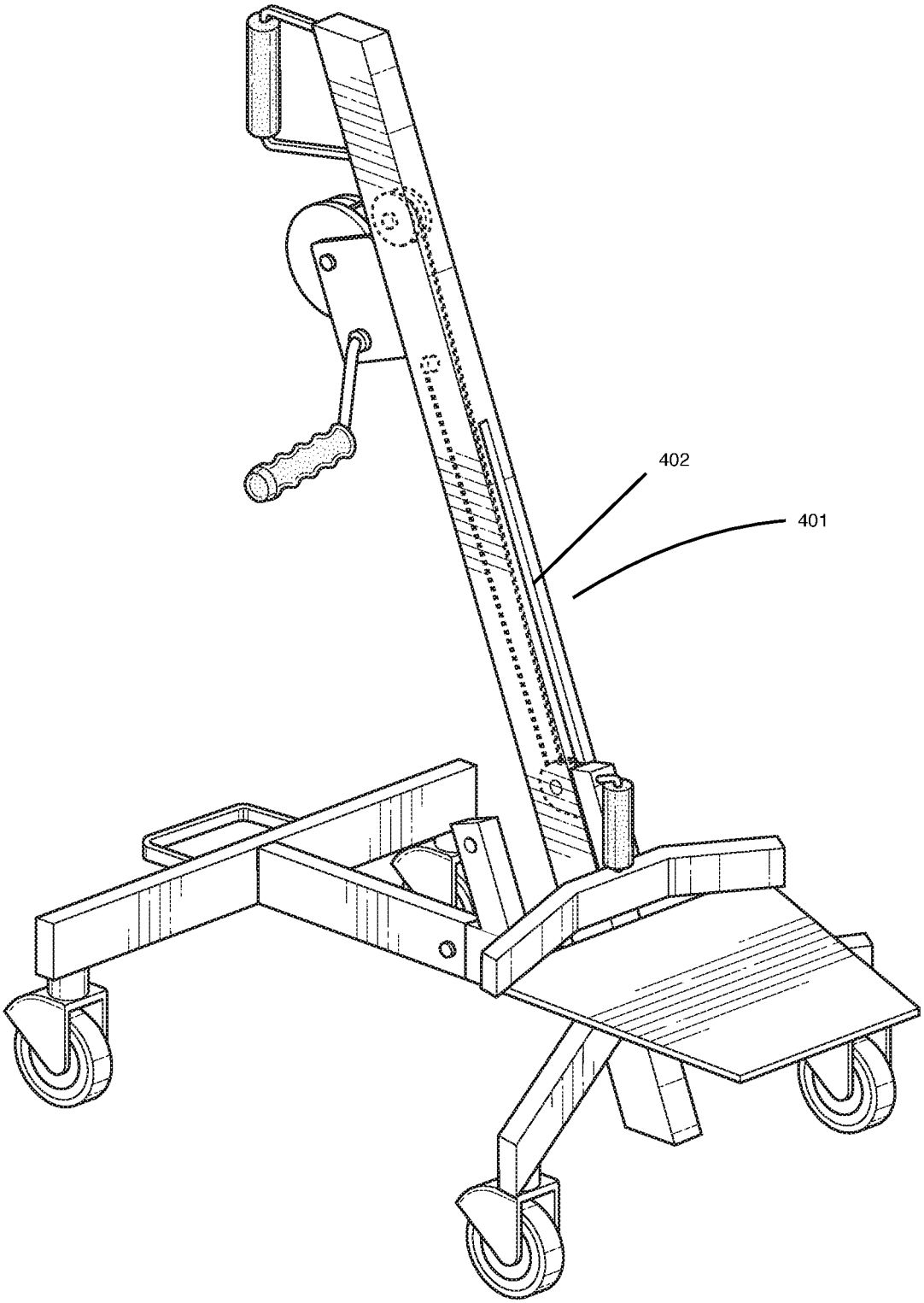
FIG. 4 shows a front perspective view of a patient lifting device in accordance with an alternative configuration of the invention.

Turning attention to FIG. 4, a front perspective view of patient lifting apparatus in accordance with an alternative embodiment of the invention is shown. FIG. 4 serves to generally show an alternative configuration of the spine 105 and cable pulley system. In the embodiment depicted, a viewer may perceive that the spine may be encased in a covering 401. To allow the cable pully system to work effectively, the covering 401 has a rectangular shaped opening 402 of sufficient width and length to allow the cable pulley rope 108 to raise and lower the platform seat 106 to the user's desired height. The covering 401 may be comprised of any material known in the art such as, but not limited to metal, plastic, or wood.

Figure 5A:
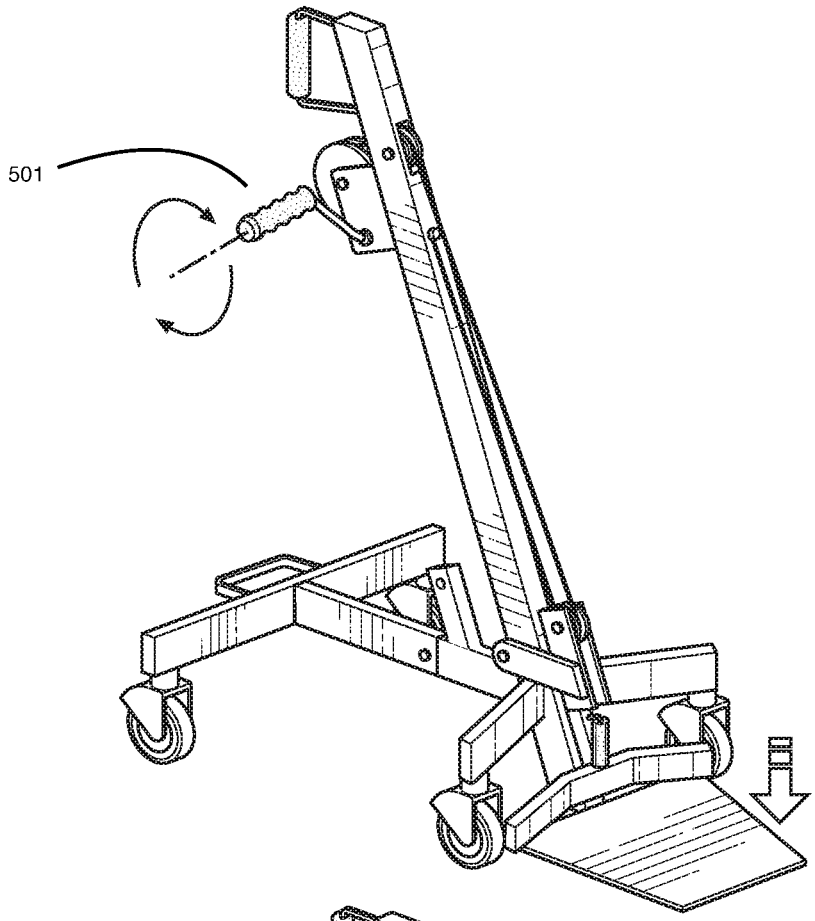
FIG. 5A shows an engaged front perspective view of a patient lifting device in accordance with an embodiment of the invention.
Figure 5B:
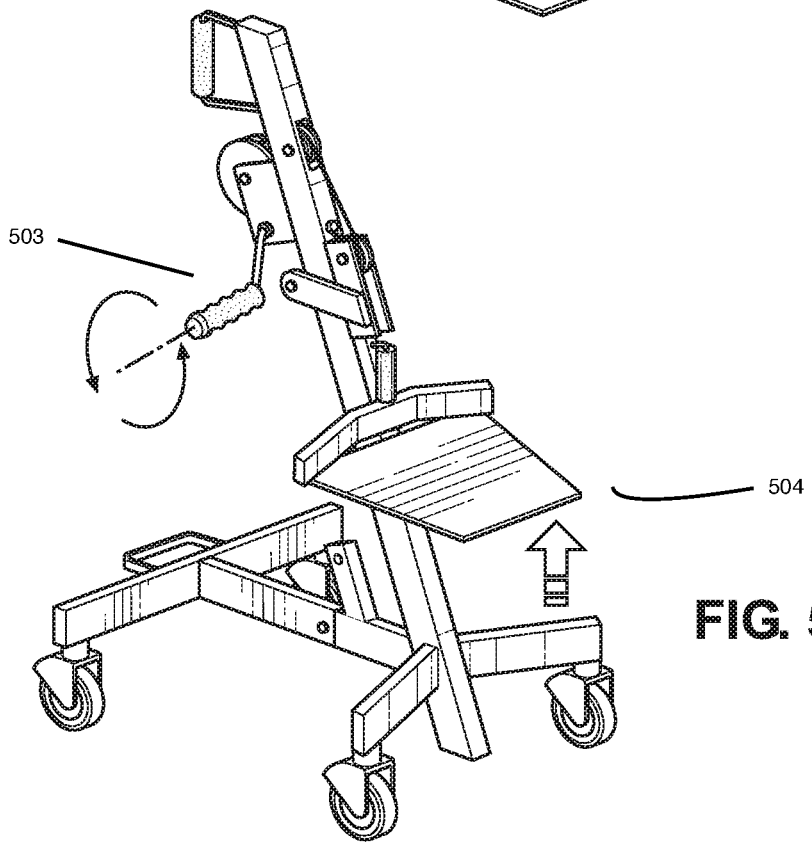
FIG. 5B shows an engaged front perspective view of a patient lifting device in accordance with an embodiment of the invention.

Turing attention to FIGS. 5A and 5B, perspective views of the patient lifting apparatus in use in accordance with an embodiment of the invention is shown. FIG. 5A serves to generally show that rotating the crank 501 in a clockwise direction lowers the platform seat 502 to the ground. FIG. 5B serves to generally show that rotating the crank 503 in a counter-clockwise direction raises the platform seat 502 up the spine.

Figure 6:
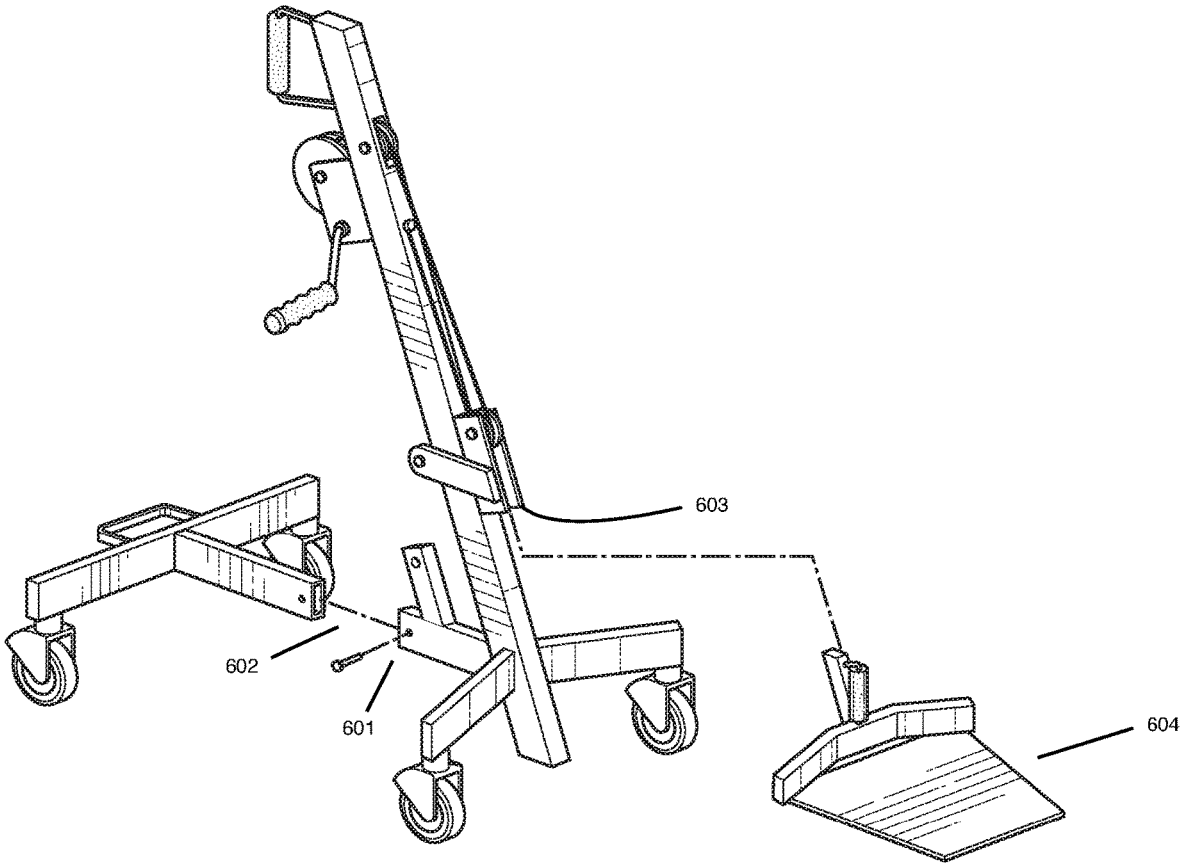
FIG. 6 shows a front perspective view of a patient lifting device while the elements of the device are detached.

With regards to FIG. 6, a perspective view of the patient lifting apparatus in accordance with an embodiment of the invention is shown. In the embodiment depicted, a viewer may perceive the patient lifting apparatus 100 in a detached configuration. The rear frame member 101 is detachably connected to the front frame member 102 and is secured by a securing pin 601 or other securing mechanism. The base male end of the Y-shaped front frame member 102 inserts into the base female end of the T-shaped rear frame member 101.

The platform seat 106 is detachably connected to the encasing frame 603 of the first wheel 107*a* and is secured by a pin or other securing mechanism (not shown). The male member 605 of the platform seat 604 inserts into female member (not shown) of the encasing frame 603 of the first wheel 107*a*.

Figure 7:
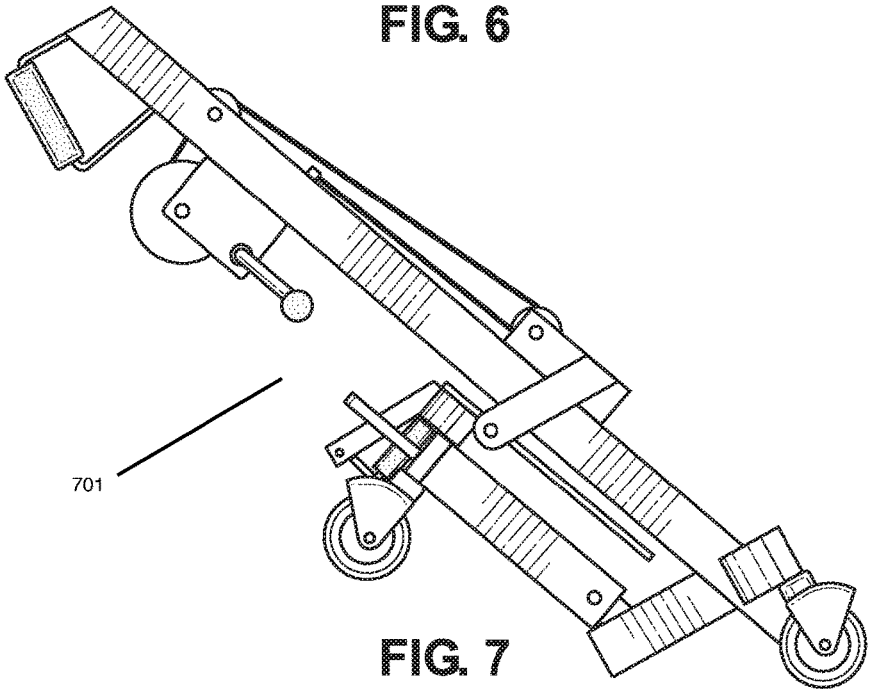
FIG. 7 shows a patient lifting device in a disengaged and in a folded position.

FIG. 7 shows a side view of the patient lifting apparatus in accordance with an embodiment of the present invention. In the embodiment depicted, a viewer may perceive that the rear base frame 101 detachably connected to the storage post and secured by a pin or other securing mechanism (not shown).

CONCLUSIONS, RAMIFICATIONS, AND SCOPE

Although the present invention has been described with a degree of particularity, it is understood that the present disclosure has been made by way of example and that other versions are possible. As various changes could be made in the above description without departing from the scope of the invention, it is intended that all matter contained in the above description or shown in the accompanying drawings shall be illustrative and not used in a limiting sense. The spirit and scope of the appended claims should not be limited to the description of the preferred versions contained in this disclosure.

All features disclosed in the specification, including the claims, abstracts, and drawings, and all the steps in any method or process disclosed, may be combined in any combination, except combinations where at least some of such features and/or steps are mutually exclusive. Each feature disclosed in the specification, including the claims, abstract, and drawings, can be replaced by alternative features serving the same, equivalent or similar purpose, unless expressly stated otherwise. Thus, unless expressly stated otherwise, each feature disclosed is one example only of a generic series of equivalent or similar features.

Any element in a claim that does not explicitly state "means" for performing a specified function or "step" for performing a specified function should not be interpreted as a "means" or "step" clause as specified in 35 U.S.C. § 112.

While the present invention generally described herein has been disclosed in connection with a number of embodiments shown and described in detail, various modifications should be readily apparent to those of skill in the art.

What is claimed is:

1. A patient lifting apparatus, comprising:

at least one base frame having at least one rear frame member and at least front frame member, wherein the rear frame member has a first end and second end, and the front frame member has a first end and second end;

at least one post fixedly connected to the first end of the front frame member, extending from the first end of the front frame member at an angle of at least 22 degrees;

wherein the first end of the rear frame member is connected to the first end of the front frame member in a first configuration, and the first end of the rear frame member is detached from the first end of the front frame member and connected to the post member in a second configuration;

at least one spine member having a first end and a second end fixedly connected to the second end of the front frame member at an angle of at least 22 degrees;

a patient support member detachably connected to the spine member, the patient support member having a first end and a second end and located on a plane defined by the base frame;

a pulley system fixedly connected to the spine member wherein the pulley system comprises a first pulley wheel and a second pulley, the pulley including a means to act between the two pulley wheels such that when force is applied a rope causes the pulley wheels to rotate.

2. A patient lifting apparatus of claim 1 wherein the first pulley wheel is encased in a frame and said frame is adapted to be mounted parallel to the spine member.

3. A patient lifting apparatus of claim 2 wherein the first end of the patient support member is detachably connected to the frame of the first pulley wheel.

4. A patient lifting apparatus of claim 1 wherein the level of the patient support member is controlled by the pulley system.

5. A patient lifting apparatus of claim 1 wherein the means to act between the two pulley wheels is a winch and a crankshaft.

6. A patient lifting apparatus of claim 5 wherein a handle is connected to said crankshaft, the turning of which rotates the crankshaft to move the rope thereby moving the patient support member along the rail of the spine member.

7. A patient lifting apparatus of claim 1 wherein the base frame sits on at least three wheels.

8. A patient lifting apparatus, comprising:

at least one base frame having at least one rear frame member and at least front frame member, wherein the rear frame member has a first end and second end, and the front frame member has a first end and second end;

at least one post fixedly connected to the first end of the front frame member, extending from the first end of the front frame member at an angle of at least 22 degrees;

wherein the first end of the rear frame member is connected to the first end of the front frame member in a first configuration, and the first end of the rear frame member is detached from the first end of the front frame member and connected to the post member in a second configuration;

at least one spine member having a first end and a second end fixedly connected to the second end of the front frame member;

a patient support member detachably connected to the spine member, the patient support member having a first end and a second end and located on a plane defined by the base frame;

a pulley system fixedly connected to the spine member wherein the pulley system comprises a first pulley wheel and a second pulley, the pulley including a means to act between the two pulley wheels such that when force is applied a rope causes the pulley wheels to rotate.

9. A patient lifting apparatus of claim 8 wherein the first end of the rear frame member and the first end of the front frame member are detachably connected by at least one engaging member.

10. A patient lifting apparatus of claim 8 wherein the first end of the rear frame member may be detached from the first end of the front frame and detachably connected to the post member by at least one engaging member.

11. A patient lifting apparatus of claim 8 wherein the second end of the rear frame member has a stabilizing handle.

* * * * *